United States Patent [19]

Arkans

[11] Patent Number: 4,481,937

[45] Date of Patent: Nov. 13, 1984

[54] SEQUENTIAL COMPRESSION DEVICE

[75] Inventor: Edward J. Arkans, Hoffman Estates, Ill.

[73] Assignee: The Kendall Company, Walpole, Mass.

[21] Appl. No.: 279,793

[22] Filed: Jul. 2, 1981

Related U.S. Application Data

[62] Division of Ser. No. 164,137, Jun. 30, 1980, Pat. No. 4,396,010.

[51] Int. Cl.[3] ..... A61H 1/00

[52] U.S. Cl. ..... 128/24 R

[58] Field of Search ..... 128/24 R, 64, 327, 675, 128/676–686

[56] References Cited

U.S. PATENT DOCUMENTS

| | | | |
|---|---|---|---|
| 3,452,744 | 7/1969 | Von Oen Nieuwenhof et al. | 128/683 |
| 3,523,527 | 8/1970 | Foster | 128/204.21 |
| 3,757,778 | 9/1973 | Graham | 128/902 X |
| 3,885,554 | 5/1975 | Rockwell, Jr. | 128/24 R |
| 4,013,069 | 3/1977 | Hasty | 128/64 |
| 4,030,488 | 6/1977 | Hasty | 128/24 R |
| 4,091,804 | 5/1978 | Hasty | 128/64 R |
| 4,253,449 | 3/1981 | Arkans et al. | 128/24 R |
| 4,294,261 | 10/1981 | Baker et al. | 128/686 X |
| 4,320,746 | 3/1982 | Arkans et al. | 128/24 R |
| 4,321,929 | 3/1982 | Lemelson et al. | 128/630 |
| 4,367,751 | 1/1983 | Link et al. | 128/682 |

*Primary Examiner*—Kyle L. Howell
*Assistant Examiner*—Christine A. Fukushima
*Attorney, Agent, or Firm*—James W. Potthast

[57] ABSTRACT

A pressure generating device for applying compressive pressures from a compressor against a patient's limb through means of a flexible, pressurizable sleeve which encloses the limb having an overpressure circuit which causes venting of the pressurizable sleeve and termination of power to the compressor in the event of the pressure assuming an excessive value. The sleeve has a ventilation chamber and a controller which generates electrical signals to actuate a solenoid controlled valve to periodically connect the compressor to the ventilation chamber during cooling cycles.

11 Claims, 4 Drawing Figures

SEQUENTIAL COMPRESSION DEVICE

This application is a division of application Ser. No. 164,137, filed June 30, 1980 now U.S. Pat. No. 4,396,010.

BACKGROUND OF THE INVENTION

The present invention relates to a device for applying compressive pressures against a patient's limb through means of a compression sleeve enclosing the limb, and, more particularly, to a circuit for preventing the application of excessive pressure and to control the application of pressure to a ventilation chamber of the sleeve.

Compression sleeves and devices for controlling them are well known and illustrated in the patent art such as U.S. Pat. Nos. 4,013,069 of Hasty; 4,030,488 of Hasty; 4,091,804 of Hasty; 4,029,087 of Dye et al; 3,942,518 of Tenteris et al; and 2,145,932 of Israel, and reference may be had thereto for general background information of structure and utility.

Briefly, a flexible compressive sleeve having a plurality of pressure compartments is wrapped around the limb of a patient, and the compartments are then intermittently pressurized to successively apply pressure compression to different parts of the limb.

One potential problem with such devices is that due to malfunction, the pressure can become so great as to discomfort or even injure the patient. Accordingly, in known devices such as those shown in the above patents, pressure release valves have been provided to prevent such occurrence. The release valves, however, tend to be relatively slow acting and do not function to terminate power to the compressor or other pressure source.

In U.S. Pat. No. 4,091,804, a sleeve is disclosed which is provided with a ventilation chamber having openings which face inwardly toward the patient's limb to inject air between the limb and the sleeve to ventilate or cool the limb. A need therefore exists for means to control the application of pressure to the ventilation chamber in coordination with the application of power to the pressure chamber.

Known controllers have been constructed from fluidic or pneumatic controls. While such types of controls function in an acceptable manner, they are subject to mechanical wear and other deterioration.

SUMMARY OF THE INVENTION

The proposed object of the present invention is to provide a single control for controlling the application of pressure to both the sleeve pressure chambers and the ventilation chamber of a flexible compression sleeve. In the preferred embodiment an electronic controller controls solenoid controlled valves to selectively connect the various chambers to the pressure source.

Yet another objective is to provide a pulse generator which is substantially electrical and electronic to avoid the problems of mechanical wear.

Further objectives, features and advantages will become more apparent from a reading of the following description of the preferred embodiment and the claims.

DESCRIPTION OF THE PREFERRED EMBODIMENT

Figure 1:
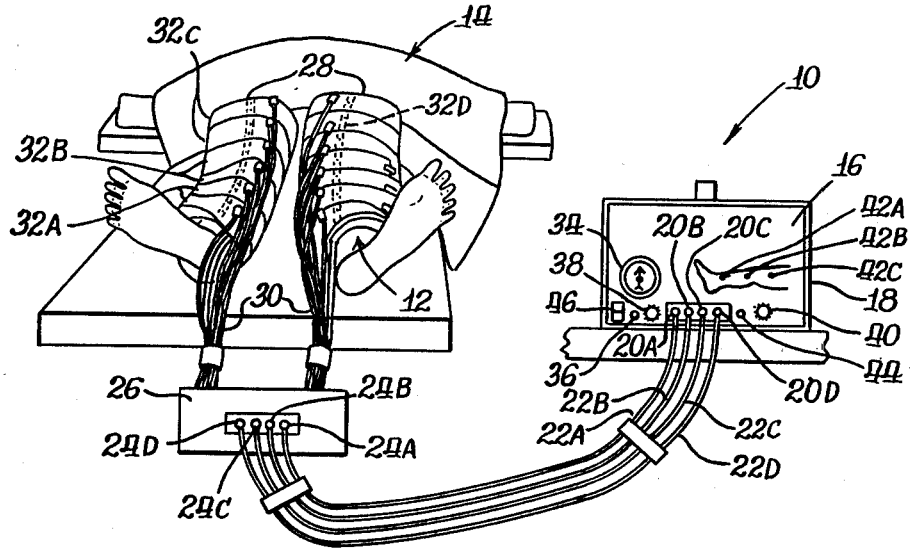
FIG. 1 is a perspective view of the sequential compression device as being used to apply compressive forces and ventilation to the legs of a patient.

Referring now to FIG. 1, the sequential compression device 10 is seen as being used to apply compressive pressures and cooling to the legs 12 of a patient 14. The device 10 includes a sequential pressure generator 16 mounted within a case 18. Generator 16, sequentially generates the pressure pulses illustrated in FIG. 3, at output ports 20A, 20B, 20C and 20D, respectively. These pressure pulses at output ports 20A–20D are respectively connected through flexible tubes 22A, 22B, 22C and 22D to input ports 24A, 24B, 24C and 24D of a manifold 26. The manifold 26 is of the type shown and described in U.S. Pat. Nos. 4,013,069 and 4,030,488 of Hasty and has two sets of four identical output ports (not shown). The four output ports of each set are respectively connected in fluid communication with the input ports 24A–24D. The two sets of output ports are respectively connected to a pair of compression sleeves 28 by a pair of flexible sets of tubes 30.

The pair of compression sleeves 28 are identical to each other. Each one is wrapped around one of the patient's legs 12 and has three pairs of contiguous pressure chambers 32A, 32B and 32C arranged longitudinally along the length of the sleeve. In addition to chambers 32A–32C, each of sleeve 28 has one or more ventilation chambers 32D with a plurality of inwardly facing openings for ventilating the patient's leg 12. The sleeves are of the type shown in U.S. Pat. Nos. 4,091,804; 4,013,069; 4,030,488 and 4,207,876 of Hasty, and reference may be had thereto for a more detailed description of the compression sleeves 28.

Each of chambers 32A are connected in fluid communication with input port 24A through a pair of flexible tubes 30 and manifold 26. Each of the pair of chambers 32B and 32C are likewise connected in fluid communication with input ports 24B and 24C of manifold 26. The ventilation chambers 32D are connected through one of flexible tubes 30 and manifold 26 to input port 24D.

Figure 3:
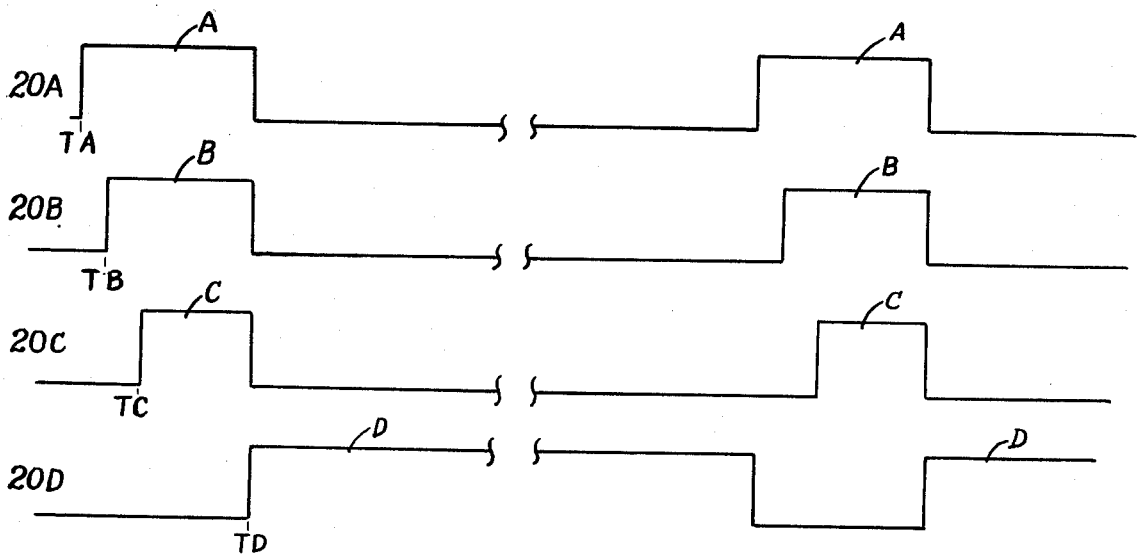
FIG. 3 is a comparative timing diagram of the electrical pulses and corresponding resultant pressure pulses generated by the pressure generator of FIG. 2.

Referring now also to FIG. 3, the pressure pulse generator 16 functions to repetitively generate pulses on its output ports 20A–20D in the time sequence shown by the wave forms of FIG. 3. As can be seen in FIG. 3, the first pulse A commences at time TA and is applied to the pair of ankle chambers 32A at the lower extremity of legs 12 in the manner described above. Then, commencement of a pulse B is generated at output port 20B at a later time TB and applied to calf chambers 32B. At yet a later time TC, commencement of a pulse C on output port 20C begins which is applied to the thigh chambers 32C. Finally, at a later time TD when pulses A, B and C terminate, the cooling pulse D is generated on output port 20D and applied to ventilation chambers 32D. At the end of cooling pulse D, a new pulse A is generated and the sequence repeats.

Referring again to FIG. 1, the pressure generator 16 is seen to include mounted to case 18, various controls and indicators. First, a pressure meter 34 is provided to indicate the pressure applied to a pair of ankle chambers 32A. An indicator light 36 is provided which lights when no pressure is being generated. A knurled, rotary knob 38 provides a means for manually adjusting the pressure. Another knurled, rotary knob 40 provides means for adjusting the cooling or ventilation pressure and thus the amount of cooling air flow being provided. Three indicator lights 42A, 42B and 42C located at appropriate ankle, calf or knee, and thigh positions on a leg form located on the outside of case 18 respectively light when pressure pulses A, B and C are generated. A fourth indicator light 44 lights when ventilation pressure pulse D is generated. Finally, a rocker switch 46 is provided to manually turn power to the pressure generator on and off. A light (not shown in FIG. 1), located behind, but visible through, switch 46 lights when power is turned on.

Figure 2:
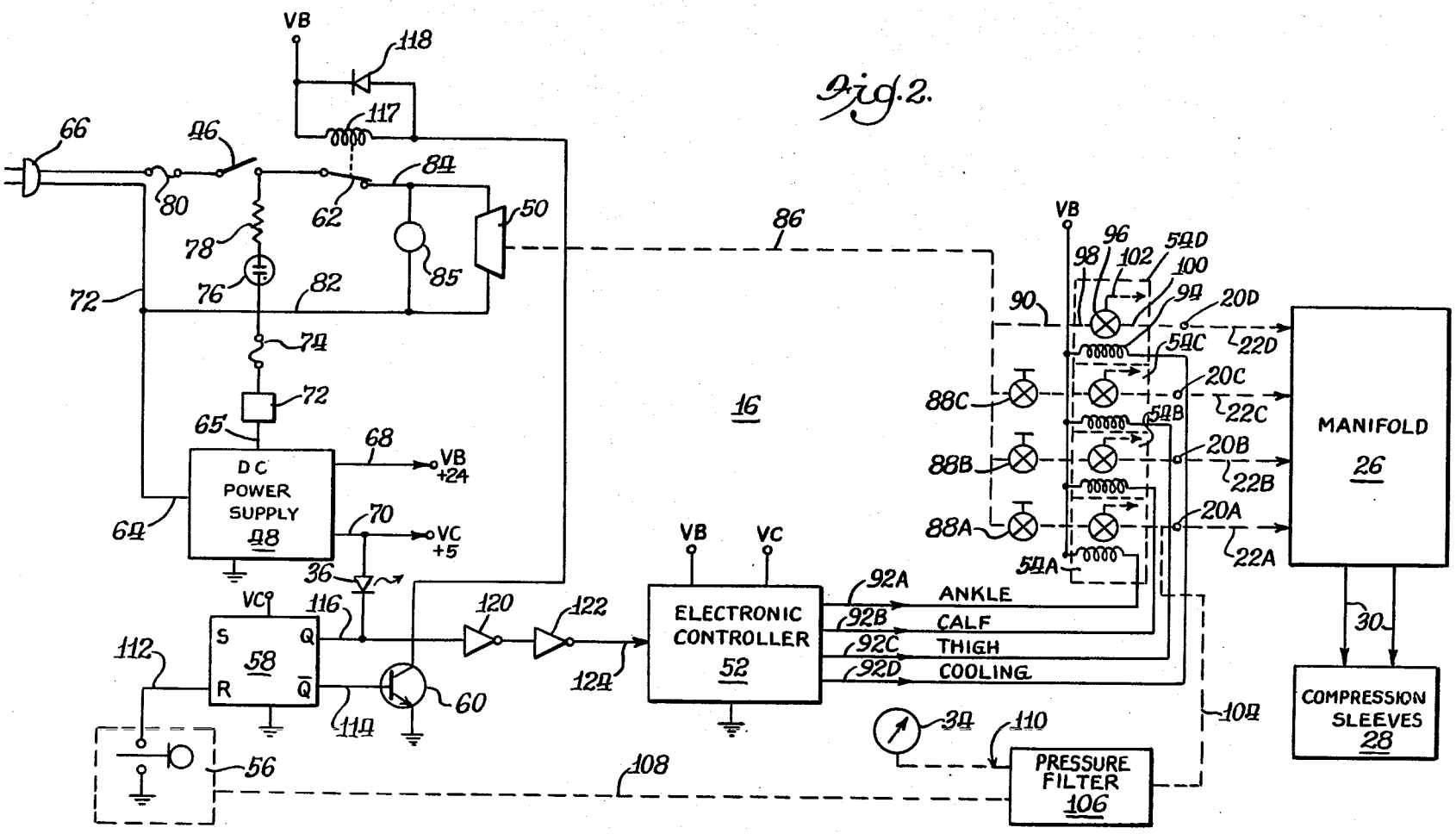
FIG. 2 is a schematic diagram, partially in block form, showing the preferred embodiment of the pulse generator portion of the device.

Referring now to FIG. 2, the structure and operation of the sequential pressure generator 16 will be described in greater detail. Dash lines are used to indicate pneumatic connections, while solid lines indicate electrical connections. Principally, the sequential pressure generator comprises a DC power supply 48 and related circuitry; a compressor 50; an electronic controller 52 (shown in greater detail in FIG. 4); four solenoid controlled valves 54A, 54B, 54C and 54D, respectively associated with pressure pulses A, B, C and D; and a safety pressure release circuit comprising a pressure switch 56, an RS flip-flop 58, a transistor 60, and a relay switch 62.

The DC power supply 48 may be of conventional form having two inputs 64 and 65 connectable to a suitable source of AC power (not shown) through an AC power plug 66 and producing two DC voltages VB, such as 24 volts DC, and VC, such as +5 volts DC, on two outputs 68 and 70. AC input 64 is connected directly to plug 66 through lead 72. Input 65, on the other hand, is connected to plug 66 through a thermal cutout switch 72, a fuse 74, a neon light, power-on, indicator 76, a resistor 78, the power switch 46 and another fuse 80. The DC voltages VB and VC are used to power the electronics on electronic controller 52 and voltage VC is also used to power the RS flip-flop 58.

The compressor 50, which includes an electric compressor motor, is connected to the AC power plug 66 to receive AC power therefrom through a lead 82 at one side thereof and through a lead 84, relay switch 62, power on-off switch 46 and fuse 80 at the other side thereof. A fan 85 for cooling the motor and other electronics is connected in parallel with compressor 50. The compressor 50 provides a single source of pressure for all of the pressure pulses A–D.

The pressure tank of compressor 50 is connected to each of the solenoid controlled valves 54A–54D through a pneumatic connection 86. The three solenoid controlled valves 54A–54C are connected to pneumatic connection 86 through suitable flow control valves 88A, 88B and 88C respectively. The cooling solenoid control valve 54D, on the other hand, is connected directly to pneumatic connection 86 through a suitable pneumatic connection 90.

The electronic controller 52 generates electronic pulses on its four outputs 92A, 92B, 92C and 94D which correspond to pressure pulses A, B, C and D, respectively. All of these solenoid controlled valves 54A–54D are identical, and each comprises a solenoid coil 94 and a two-way valve 96. Each of the valves has an input 98 connected to pneumatic connection 86 and compressor 50, an output 100 connected to the associated one of pressure output ports 20A–20D, and a venting output 102 which is open to the atmosphere. When the coil 94 is energized, the valve switches to a state in which the pressure at its input 90 is coupled to its output 100 and thus to the associated output port 20A–20D. When the coil is not energized, the valve vents the output 100 to atmosphere through venting output 102 and closes the connection between compressor 50 and the associated output port 20A–20D.

Thus, whenever the electronic controller 52 generates an output signal on one of its outputs 92A–92D to energize the solenoid controlled valve coil 94 connected therewith, a pressure pulse is applied to the associated output port 20A–20D. Conversely, when the electronic controller 52 does not generate an output to energize one of the coils, the solenoid controlled valve 96 associated therewith vents the output port to venting output 102.

One of the particularly advantageous features of the present invention is the provision of the safety pressure release circuitry. As previously explained, if the pressure becomes too great, the patient can suffer discomfort and even injury. The pressure at the output port 20A is monitored by the pressure actuated switch 56. Switch 56 is connected to the pressure output port 20A through a pneumatic connection 104, a pressure filter 106, and another pneumatic connection 108. Pressure filter 106 comprises a fitting with an orifice of sufficiently small dimension, so that the pressure appearing on output 108 follows only the average pressure applied to the input from pneumatic connection 104 and not the transient pressure pulses. Another output of pressure filter 106 is connected to the pressure gauge 34 through a pneumatic connection 110.

When the pressure produced at output port 20A exceeds a preselected value, the pressure switch 56, which is normally open as shown, switches to a closed position to connect ground reference to reset input 112 of RS flip-flop 58. This causes the flip-flop 58 to reset to a state in which a positive voltage pulse or 1-state signal is produced on its inverting output 114 and a ground voltage or 0-state signal is produced on its normal output 116. The no-pressure light 36, which comprises a light emitting diode, is connected between supply voltage VC and output 116 and is energized and lights when inverting output 114 switches to the 0-state. More importantly, inverting output 114 is connected to the base of NPN transistor 60, and when the 1-state signal is applied to the base, the transistor 60 turns on to energize relay coil 117 causing relay switch 62 to switch from its normally closed condition, as shown, to an open condition. A free wheeling diode 118 is connected in parallel with relay coil 117. When switch 62 opens, AC power is disconnected from compressor 50, so that no further pressure increases are allowed. In addition to the compressor 50 being turned off, the 0-state signal on normal output 116 is coupled through inverters 120 and 122 to an input 124 of electronic controller 52. As will be explained with reference to FIG. 4, this 0-state signal at input 124 causes the electronic controller to terminate all signals on its outputs 92A–92D to de-energize all solenoid coils 94 of solenoid control valves 54A–54D. This causes all of the controlled valves to switch to their venting position to deflate the compression sleeves 28.

Figure 4:
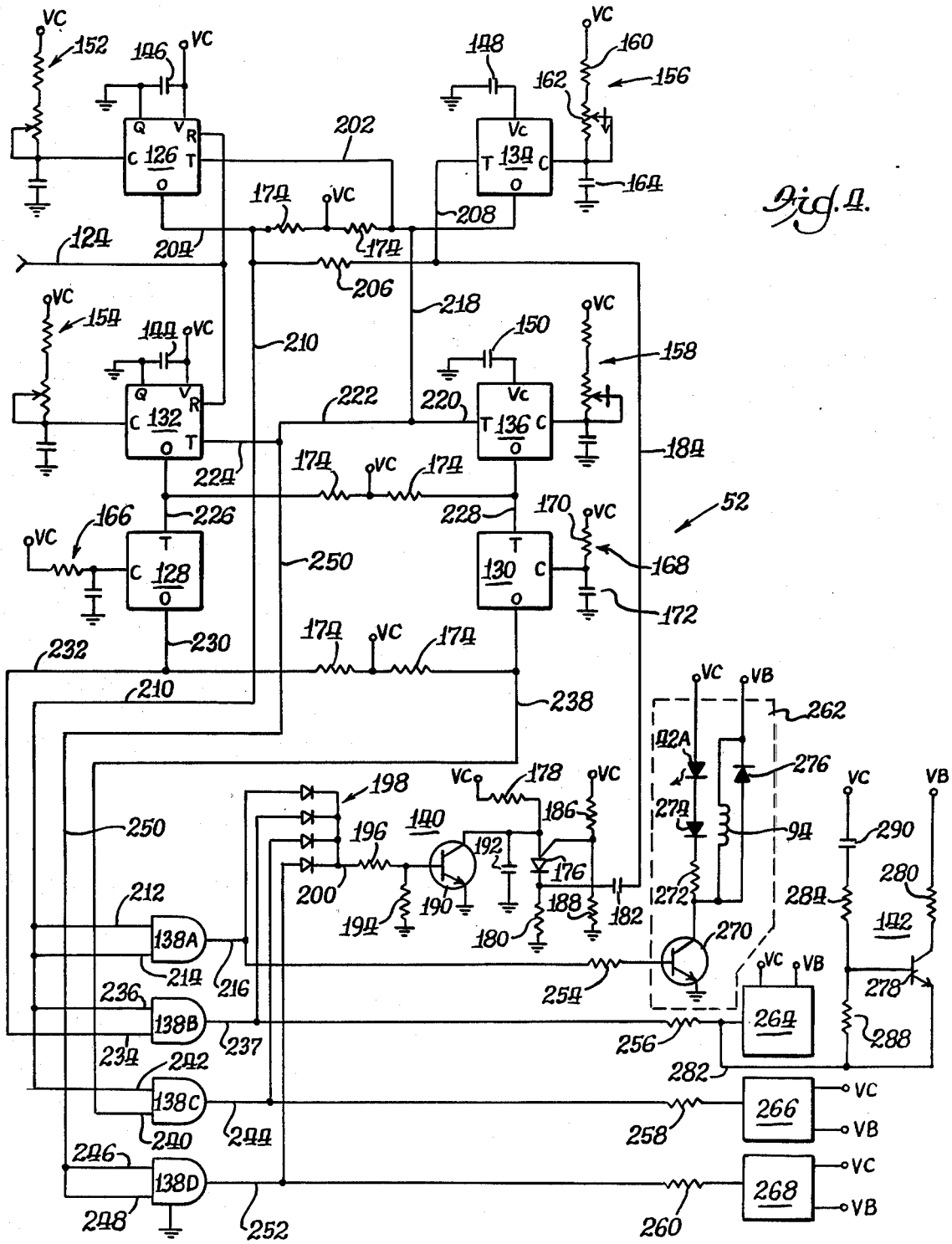
FIG. 4 is a schematic diagram of the electronic controller shown in FIG. 2.

Referring now to FIG. 4, the electronic controller 52 is seen to comprise six electronic timers 126, 128, 130, 132, 134 and 136; four AND gates 138A, 138B, 138C and 138D, respectively associated with pulses A, B, C and D; an antilatch circuit 140; and a startup circuit 142. The timers generate signals on their various outputs which are coupled to AND gates 138A–138D to generate electronic pulses that cause generation of corresponding pressure pulses. The antilatch circuit triggers one of the timers to start a timing sequence in the event circumstances causing none of AND gates 138A–138D generating 1-state signals on their outputs. The startup circuit 142 functions to energize solenoid coil 94 of solenoid controlled valve 54C upon turn-on of power to reduce the load on the compressor motor upon power turn-on to minimize transients.

The six timers are contained in two identical integrated circuit packages, preferably quad timers 558/559 manufactured by Signetics and described at page 155 of Signetics Data Manual, published 1976 by Signetics Corporation. Reference may be had to such Signetics publication, but briefly, each timer comprises a monostable multivibrator, or one-shot, circuit having three principal inputs: a trigger input T which responds to negative voltage transitions, a control input C which determines the period of the timer, and an output 0. When the trigger input of each timer is provided with a negative transient signal, its output assumes a 1-state and remains in that 1-state for a preselected period of time determined by a timing control circuit connected to control input C.

At the end of the timing period, the output returns to a 0-state. Timers 126, 128 and 130, are contained within one of the integrated circuit packages, and timers 132, 134 and 136 are contained in another identical circuit package. Each circuit package also has four common inputs for each of the timers contained in the package. These common inputs are shown as being connected to only some of the timers, but it should be understood that such inputs are in fact internally connected to each of the timers of the package. These common inputs include inputs G and V, shown only on timers 126 and 132, respectively connected to ground and supply voltage VC. Filter capacitors 144 and 146 are connected between these two inputs of the two packages, respectively, to minimize adverse noise effects. Another input common to both packages is a reset input R, shown only on timers 126 and 132. Whenever a 0-state signal is applied to the R input of the package, the outputs 0 of all timers of that package revert to a 0-state. These two reset inputs R are connected to output 124, described above in reference to FIG. 2, so that all timers are reset with their outputs in a 0-state upon closure of pressure switch 56. As will be made apparent hereinafter, this causes all of the solenoid coils 94 to be de-energized to cause the solenoid controlled valves 96 to switch their outputs 100 to venting output 102. The last remaining common input is input Vc, shown only on timers 134 and 136. As seen, these two inputs are connected to ground through filter capacitors 148 and 150, respectively. These inputs can be used to control the threshold voltage that the voltage signal applied to control input C must reach to cause the end of the timing period. The capacitor connections to ground merely function to prevent the inputs from responding to noise and other transients.

Each of timers 126, 132, 134 and 136 have variable time control circuits 152, 154, 156 and 158 connected thereto. Each comprises a fixed resistor 160, a variable resistor 162, and a capacitor 164 connected in series between supply voltage VC and ground. The junction between the variable resistor 162 and the capacitor 164 is connected to the control input C. By varying the value of resistor 162, the time duration of the output pulse produced on output 0 of each of these timers may be varied accordingly for reasons set forth below. Timers 128 and 130, on the other hand, have two, identical, fixed, time control circuits 166 and 168 connected thereto, respectively. Each of these time control circuits comprise a resistor 170 and capacitor 172 connected in series between ground and supply voltage VC. The junction between the resistor 170 and capacitor 172 is connected to control input C, and the relative values of the resistor and capacitor determine the time period of these timers.

The antilatch circuit has an SCR 176 with its cathode connected to a resistor 178 to supply voltage VC and its anode connnected through another resistor 180 to ground. The junction between the anode and resistor 180 is AC coupled through a capacitor 182 and lead 184 to trigger input T of timing circuit 134. The gate of SCR 176 is connected to the junction of two resistors 186 and 188 which are connected in series between supply voltage VC and ground. Thus, a positive signal is normally applied to the gate of SCR 176 to keep it in a conductive state.

Also connected to the cathode of SCR 176 is an NPN transistor 190. A turn-on delay capacitor 192 is connected between the collector transistor 190 and ground, and the emitter of transistor 190 is connected directly to ground. The base of transistor 190 is connected to the junction between two resistors 194 and 196 which form a voltage divider coupled between ground and the output of a diode OR gate 198. OR gate 198 is formed from four diodes having their cathodes commonly connected together to resistor 196 and their anodes respectively connected to the outputs of AND gates 138A, 138B, 138C and 138D. At power turn-on or in the event of any other circumstances causing all of the outputs from timers 126, 128, 130 and 134 to be in a 0-state simultaneously, a 0-state signal is applied to the output 200 of diode OR gate 198. This causes transistor 190 to turn off to raise anode voltage of SCR 176 to turn it on and raise its cathode voltage. As a result, a positive pulse appears on trigger input T of timer 134 through capacitor 182. The negative going trailing edge of this pulse triggers timer 134 to a 1-state and starts the timing period.

Presuming this to be the case, application of the negative transistor signal to input T of timer 134 will cause capacitor 164 to discharge and after the period of timer 134 is passed, the signal on its output 0 will switch to a 0-state. While other times may be selected, in the preferred embodiment the time period for timer 134 is 60 seconds. The time periods for timers 126, 128, 130, 132 and 136 are preferably 11 seconds, 15.5 seconds, 15.5 seconds, 2.5 seconds and 5.5 seconds. The timers normally have a 0-state output. When a trigger pulse is applied to the trigger input T of any one of the timers, its output will switch to a 1-state and remain in that state until expiration of its associated timing period. Each of the outputs 0 of the timers has a pull-up resistor 174 through which it is connected to supply voltage VC. The pull-up resistors 174 allow the outputs to rise in this 1-state during this time.

After 60 seconds the output of timer 134 will switch to a 0-state. The negative transition of this output is coupled through a lead 202 to the trigger input of timer 126 which causes its output to switch to a 1-state and to remain in that state for 11 seconds. The output of timer 126 is coupled through a lead 204, a resistor 206, and a lead 208 to the trigger input T of timer 134, and at the end of the 11-second period when the output of the timer 126 switches back to a 0-state, timer 134 is triggered back into a 1-state where it remains for another 60 seconds.

The 1-state signal on output 0 of timer 126 is coupled through another lead 210 to both inputs 212 and 214 of AND gate 138A. AND gate 138A in response to that condition, produces a 1-state signal on its output 216 corresponding to pulse A and lasting for 11 seconds.

The negative transition on the output of timer 134 at the beginning of the 11-second pulse is coupled through a lead 218 and a lead 220 to the trigger input T of timer 136. It is also coupled through lead 218 and a lead 222 and 224 to the trigger input of timer 132. Thus, at the beginning of the 11-second pulse, a 2.5 second 1-state pulse is produced on the output of timer 132 and a 5.5 1-state pulse is produced on the output of timer 136. The outputs of timers 132 and 136 are respectively coupled to the trigger inputs T of timers 128 and 130 through leads 220, 226 and 228, respectively. Thus, at the end of the 2.5 second pulse, a 15.5 second 1-state pulse is produced on the output of timer 128, and after 5.5 seconds a 15.5 second 1-state pulse is produced on the output of timer 130.

The output of timer 128 is coupled through a lead 230 and a lead 232 to an input 234 of AND gate 138B. The other input 236 of AND gate 138B is coupled to the output of timer 126 through lead 210. Thus, AND gate 138B produces a 1-state pulse which commences 2.5 seconds after commencement of the 11-second 1-state pulse on the output of 138A which lasts 8.5 seconds (11 seconds minus 2.5 seconds) and ends concurrently with the termination of the 11-second pulse.

The output of timer 130 is coupled through a lead 238 to an input 240 of AND gate 138C. The other input 242 of AND gate 138C is coupled through a lead 210 to the output of timer 126. Thus, AND gate 138C produces a 1-state pulse on its output 244 commencing 5.5 seconds after commencement of the 11-second pulse, having a duration of 6.5 seconds and ending concurrently with the 11-second pulse.

Both inputs 246 and 248 are coupled through a lead 250, lead 222 and lead 218 to the output of timer 134. Accordingly, AND gate 138D produces a 1-state signal on its output 252 having a 60-second duration coincident with the output pulse produced on the output of timer 134.

AND gate output 216, 237, 244 and 252 are respectively connected through resistors 254, 256, 258 and 260 to output circuits 262, 264, 266 and 268, respectively. All of these circuits are identical with one another, and for the sake of brevity, only the output circuit 262 is shown and described. Referring to circuit 262, it is seen to comprise a transistor 270 having its emitter connected to ground and its collector connected to a load resistor 272, a diode 274 and the light emitting diode 42A to supply voltage VC. In addition, the solenoid coil 94 is connected between the supply voltage VB and the collector transistor 270. A diode 276 is connected in parallel with solenoid coil 94. Consequently, when the 11-second pulse is produced on output 216 of AND gate 138A, transistor 270 turns on to cause light emitting diode 42A to light and to energize solenoid coil 94 which switches valve 96 of solenoid controlled valve 54A to connect compressor 50 to pressure outlet port 20A. At the end of the 1-state pulse, transistor 270 turns off which causes the valve to switch to its venting position and causes light emitting diode 42A to turn off.

Circuits 264, 266 and 268 contain the light emitting diodes 42B, 42C and 44, respectively, and the solenoid coils 94 of solenoid control valve 54B, 54C and 54D, respectively. During the 8.5 second pulse produced on the output 237 of AND gate 138B, light emitting diode 42B is lit as ventilating pressure is applied to pressure outlet port 20D. Likewise, during the pulses produced on the outputs of AND gates 138C and 138D, light emitting diodes 42C and 44 are lit and pressure pulses are produced on outlet ports 20C and 20D, respectively.

To prevent transients which might cause fuses to blow and undesirable surges in the compressor motor during initial application of power, power turn-on circuit 142 functions to energize the solenoid coil 94 of solenoid controlled valve 54B. This enables the compressor motor to work against at least one open valve. The circuit 142 comprises a transistor 278 with its collector connected to supply voltage VB through a resistor 280 and with its emitter directly connected to the switching transistor circuit 64 (not shown) through a lead 282. The base of transistor 278 is connected to the junction between a pair of resistors 284 and 288 which are connected in series with a capacitor 290 between the emitter and supply voltage VC. Normally, transistor 278 is in a nonconductive state and has no effect on the rest of the circuitry. However, when power is first applied, a positive pulse is coupled through capacitor 290 to the base of transistor 278, temporarily turning it on which in turn temporarily turns on the switching transistor of 264 to open its associated valve.

As can be appreciated, because of the variable resistors 162 associated with the time period control circuits 152, 154, 156 and 158 the duration of each of pulses A, B, C and D may be selectively varied to meet the needs of the patient or other circumstances. The pulse duration of each of these pulses may be changed independently without changing the duration of the other pulses. The duration of pulse A is completely determined by time period control circuit 152. Likewise, the duration of pulse D is completely controlled by the time period control circuit 156. While the maximum duration of pulses B and C is determined by the duration of pulse A, otherwise, pulses B and C are completely controlled by time period control circuits 154 and 158, respectively.

The foregoing detailed description is given for clearness of understanding only, and no unnecessary limitations should be understood therefrom, as modifications will be obvious to those skilled in the art.

I claim:

1. In a pressure generating device for applying compressive forces against a patient's limb through means of a flexible sleeve connectable therewith and enclosing the limb, said sleeve having a plurality of closed pressure chambers and a ventilation chamber with a plurality of openings facing the limb when enclosed therein, the improvement comprising:

a source of pressurizable fluid;

a plurality of first valve members connected between the source and the plurality of pressure chambers, respectively;

a second valve member connected between the source and the ventilation chamber; and means connected with the valve members for electronically controlling them to periodically apply pressure to said chambers said electronic controlling means including means for successively generating a plurality of first electrical actuation signals for actuating said plurality of first valve members to successively pressurize said plurality of pressure chambers, respectively, means for substantially simultaneously terminating said plurality of first electrical actuation signals to substantially simultaneously deactuate all of said plurality of first valve members, means for generating a second actuation signal for actuating said second valve member to couple said source of pressurizable fluid to the ventilation chamber substantially concurrently with termination of all of said first actuation signals, and means for terminating said second actuation signal for deactuating said second valve member substantially concurrently with the next actuation of the first pressure chamber.

2. The pressure generating device of claim 1 in which each of said valve members is a solenoid controlled valve, and said electronically controlling means includes means for selectively energizing the solenoids of said valves during generation of the electrical actuation signals associated therewith.

3. The pressure generating device of claim 1 in which said electronic controlling means includes means for providing an indication when each of the first valve members is provided with an electrical actuation signal.

4. The pressure generating device of claim 1 or 3 in which said electronic controlling means includes means for providing an indication when the second valve member is provided with the second electrical actuation signal.

5. The pressure generating device of claim 4 in which said indication providing means is a light mounted at a position on a limb form which identifies the chamber associated therewith, each of said lights being energized in response to generation of the actuation signal associated therewith.

6. The pressure generating device of claim 1 in which said electronic controlling means includes a plurality of electronic timers which generate pulses of selected duration, and an electronic logic circuit responsive to said pulses to generate said electrical actuation signals at preselected times.

7. The pressure generating device of claim 6 in which said electronic controlling means includes means for selectively varying the time periods of at least some of said timers to vary the duration of the application of pressure to said chambers.

8. The pressure generating device of claim 1 in which said valve actuating means includes means for actuating at least one of the valve members connected with a pressure chamber in response to the end of actuation of the valve connected with the ventilation chamber.

9. The pressure generating device of claim 1 in which said controller includes means for periodically actuating said valves in a preselected order.

10. The pressure generating device of claim 1 in which said controller includes means for selectively varying the periods of actuation of the valves.

11. The pressure generating device of claim 10 in which said varying means includes a timing circuit with a variable impedance.

* * * * *